US008550204B2

(12) United States Patent
Takagi

(10) Patent No.: US 8,550,204 B2
(45) Date of Patent: Oct. 8, 2013

(54) EXHAUST DEVICE OF A VEHICLE AND A UTILITY VEHICLE PROVIDED WITH THE SAME

(75) Inventor: Jun Takagi, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 99 days.

(21) Appl. No.: 12/979,668

(22) Filed: Dec. 28, 2010

(65) Prior Publication Data

US 2012/0160588 A1 Jun. 28, 2012

(51) Int. Cl.
*B60K 13/04* (2006.01)

(52) U.S. Cl.
USPC ..... 180/309; 180/296; 180/89.2

(58) Field of Classification Search
USPC ..... 180/291, 292, 296, 297, 68.3, 69.1, 180/312, 309, 89.2; 181/228; 60/323
See application file for complete search history.

(56) References Cited

U.S. PATENT DOCUMENTS 4,068,646 A * 1/1978 Hnojsky ..... 123/195 C
4,731,993 A * 3/1988 Ito et al. ..... 60/299
4,860,538 A * 8/1989 Takeuchi ..... 60/313
5,152,138 A * 10/1992 Tanabe et al. ..... 60/313
5,239,826 A * 8/1993 Hirota et al. ..... 60/302
5,704,819 A * 1/1998 Isogawa ..... 440/88 L
6,374,600 B2 * 4/2002 Uegane et al. ..... 60/322
6,719,084 B2 * 4/2004 Kuji et al. ..... 180/309
6,907,726 B2 * 6/2005 Kim ..... 60/323
7,017,339 B2 * 3/2006 Konstantakopoulos et al. ..... 60/323
7,363,999 B2 * 4/2008 Hastings ..... 180/220
7,438,153 B2 * 10/2008 Kalsnes et al. ..... 180/292
8,002,061 B2 * 8/2011 Yamamura et al. ..... 180/68.1
2007/0277517 A1 * 12/2007 Yamakura et al. ..... 60/323
2009/0183937 A1 * 7/2009 Yamamura et al. ..... 180/89.2

* cited by examiner

*Primary Examiner* — Katy M Ebner
*Assistant Examiner* — Emma K Frick
(74) *Attorney, Agent, or Firm* — Wenderoth, Lind & Ponack, LLP

(57) ABSTRACT

An exhaust device of a vehicle, provided with a V-engine (5) having a front cylinder (52) and a rear cylinder (53), has a muffler (93) arranged in a rear part of the vehicle. A front cylinder exhaust pipe (91) is connected to a front surface of the front cylinder (52), and a rear cylinder exhaust pipe (92) is connected to a rear surface of the rear cylinder (53). A collecting pipe (94) is provided to collect the front cylinder exhaust pipe and the rear cylinder exhaust pipe. Also, a downstream exhaust pipe (95) extends from the collecting pipe to the muffler. The total length of the front cylinder exhaust pipe and the total length of the rear cylinder exhaust pipe are substantially the same.

13 Claims, 6 Drawing Sheets

EXHAUST DEVICE OF A VEHICLE AND A UTILITY VEHICLE PROVIDED WITH THE SAME

BACKGROUND OF THE INVENTION

1. Field of the Invention

The present invention relates to an exhaust device of a vehicle provided with an engine, and a running vehicle provided with the same, particularly to a utility vehicle mainly suitable for running on irregular terrain.

2. Description of the Related Art

Conventionally, in a utility vehicle provided with a V-engine having a front cylinder and a rear cylinder, as shown in FIG. 4 of U.S. Pat. No. 6,719,084, a front cylinder exhaust pipe connected to a front surface of the front cylinder, the front cylinder exhaust pipe reaching to a muffler has longer total length than a rear cylinder exhaust pipe connected to a rear surface of the rear cylinder, the rear cylinder exhaust pipe reaching to the muffler.

SUMMARY OF THE INVENTION

When the front cylinder exhaust pipe is longer than the rear cylinder exhaust pipe, exhaust interference is generated between the front cylinder exhaust pipe and the rear cylinder exhaust pipe, or a difference in an exhaust performance is generated between the front and rear cylinders, so that an output of the engine tends to be lowered. Therefore, an object of the present invention is to provide an exhaust device capable of suppressing the exhaust interference generated between the front cylinder exhaust pipe and the rear cylinder exhaust pipe, and further substantially equalizing the exhaust performance of the front and rear cylinders.

A first aspect of the present invention is an exhaust device of a vehicle provided with a V-engine having a front cylinder and a rear cylinder, including a muffler arranged in a rear part of the vehicle, a front cylinder exhaust pipe connected to a front surface of the front cylinder, a rear cylinder exhaust pipe connected to a rear surface of the rear cylinder, a collecting pipe collecting the front cylinder exhaust pipe and the rear cylinder exhaust pipe, and a downstream exhaust pipe reaching from the collecting pipe to the muffler, wherein total length of the front cylinder exhaust pipe and total length of the rear cylinder exhaust pipe are substantially the same.

With the above configuration, the total length of the front cylinder exhaust pipe and the total length of the rear cylinder exhaust pipe are substantially the same. Thus, the exhaust interference generated between the front cylinder exhaust pipe and the rear cylinder exhaust pipe can be suppressed, and further the exhaust performance of the front and rear cylinders can be substantially equalized. As a result, the output of the engine can be improved.

The first aspect of the present invention is preferably provided with the following configurations.

(1) The collecting pipe is arranged on the side in the lateral direction of a rear part of the engine, the front cylinder exhaust pipe has a front exhaust pipe curved portion changing the direction from forward to rearward, the front exhaust pipe curved portion is positioned in the vicinity of the front side of the engine, the rear cylinder exhaust pipe has, in order from the exhaust upstream side, a first rear exhaust pipe curved portion changing the direction from rearward to forward, and a second rear exhaust pipe curved portion changing the direction from forward to rearward, the first rear exhaust pipe curved portion is positioned in the vicinity of the rear side of the engine, and the second rear exhaust pipe curved portion is positioned in the vicinity of the side in the lateral direction of the rear part of the engine.

(2) In the above configuration (1), the collecting pipe is arranged on the opposite side in the lateral direction of a fuel tank or a transmission of the vehicle relative to the engine.

(3) In the above configuration (1), the front cylinder exhaust pipe has a front exhaust pipe straight portion formed into a straight line in a connection part to the collecting pipe, and the rear cylinder exhaust pipe has a rear exhaust pipe straight portion formed into a straight line in a connection part to the collecting pipe.

(4) In the above configuration (2), the front exhaust pipe straight portion and the rear exhaust pipe straight portion are integrally supported by a shared support member.

(5) In the above configuration (1), a cutout portion of an oil pan is formed in a side part in the lateral direction of the oil pan of the engine, and a part of the second rear exhaust pipe curved portion is positioned in the vicinity of the cutout portion.

(6) The vehicle has a front seat and a rear seat in order from the front side, the engine is arranged on the lower side of a substantially center part in the lateral direction of the front seat, the muffler is arranged in the vicinity of the lower side of a loading platform in a rear part of the rear seat and in a substantially center part in the lateral direction, and the downstream exhaust pipe reaches to the muffler through the lower side of the substantially center part in the lateral direction of the rear seat.

The configuration (1) is a specific configuration that the total length of the front cylinder exhaust pipe and the total length of the rear cylinder exhaust pipe are substantially the same. With the above configuration (1), the total length of the front cylinder exhaust pipe and the total length of the rear cylinder exhaust pipe can easily be made substantially the same. With the above configuration (1), the front cylinder exhaust pipe and the rear cylinder exhaust pipe can be arranged around the engine. Thus, a thermal influence from the front cylinder exhaust pipe and the rear cylinder exhaust pipe to the outer side in the lateral direction can be reduced.

With the configuration (2), the collecting pipe is arranged on the opposite side in the lateral direction of the fuel tank or the transmission of the vehicle relative to the engine. Thus, the front cylinder exhaust pipe, the rear cylinder exhaust pipe, and the collecting pipe having a relatively high temperature among the exhaust pipes are spaced from the fuel tank or the transmission by a fixed distance via the engine. Therefore, the thermal influence on the fuel tank or the transmission by the front cylinder exhaust pipe, the rear cylinder exhaust pipe, and the collecting pipe can be reduced.

With the configuration (3), the front cylinder exhaust pipe and the rear cylinder exhaust pipe respectively have the front exhaust pipe straight portion formed into a straight line and the rear exhaust pipe straight portion formed into a straight line in the connection parts to the collecting pipe. Thus, movement of exhaust from the front cylinder exhaust pipe to the collecting pipe, and movement of exhaust from the rear cylinder exhaust pipe to the collecting pipe can be smoothly performed.

With the above configuration (4), the front exhaust pipe straight portion and the rear exhaust pipe straight portion are integrally supported by the shared support member. Thus, the support member can be simplified, so that the front exhaust pipe straight portion and the rear exhaust pipe straight portion can be supported in a rational manner. By improving integrity of the front cylinder exhaust pipe and the rear cylinder exhaust pipe, vibration generated between the front cylinder exhaust pipe and the rear cylinder exhaust pipe can be eased.

With the above configuration (5), a part of the second rear exhaust pipe curved portion is positioned in the vicinity of the cutout portion of the oil pan. Thus, the rear cylinder exhaust pipe can be brought close to the side in the lateral direction of the engine, so that the thermal influence from the rear cylinder exhaust pipe to the outer side in the lateral direction can be reduced.

With the above configuration (6), the engine and the muffler are arranged in the substantially center part in the lateral direction, and the downstream exhaust pipe passes through the lower side of the substantially center part in the lateral direction of the rear seat. Thus, total length of the downstream exhaust pipe can be shortened. As a result, weight of the downstream exhaust pipe can be reduced, and the output of the engine at the time of high speed can be improved. Since the downstream exhaust pipe is arranged in the substantially center part in the lateral direction, the thermal influence from the downstream exhaust pipe to the outer side in the lateral direction can be reduced.

A second aspect of the present invention is an exhaust device of a vehicle provided with an engine having one or more cylinder, including a muffler, and an exhaust pipe connected to the cylinder, the exhaust pipe reaching to the muffler, wherein the vehicle has a front seat and a rear seat in order from the front side, the engine is arranged on the lower side of a substantially center part in the lateral direction of the front seat, the muffler is arranged in the vicinity of the lower side of a loading platform in a rear part of the rear seat and in a substantially center part in the lateral direction, and the exhaust pipe reaches to the muffler through the lower side of the substantially center part in the lateral direction of the rear seat.

With the above configuration, the engine and the muffler are arranged in the substantially center part in the lateral direction, and the exhaust pipe passes through the lower side of the substantially center part in the lateral direction of the rear seat. Thus, total length of the exhaust pipe can be shortened. As a result, weight of the exhaust pipe can be reduced, and the output of the engine at the time of high speed can be improved. Since the exhaust pipe is arranged in the substantially center part in the lateral direction, the thermal influence from the exhaust pipe to the outer side in the lateral direction can be reduced.

A third aspect of the present invention is a utility vehicle provided with the exhaust device of the first aspect or the second aspect of the present invention.

With the above configuration, the utility vehicle having an effect of the first aspect of the present invention or an effect of the second aspect of the present invention can be provided.

In sum, according to the present invention, the exhaust interference generated between the front cylinder exhaust pipe and the rear cylinder exhaust pipe can be suppressed, and further the exhaust performance of the front and rear cylinders can be substantially equalized.

DETAILED DESCRIPTION OF THE INVENTION

FIGS. 1 to 5 show a utility vehicle and an exhaust device according to an embodiment of the present invention. The present embodiment will be described based on the drawings. It should be noted that in the following description, a concept of the direction used in the present embodiment corresponds to a concept of the direction seen from a driver of the utility vehicle.

Figure 1:
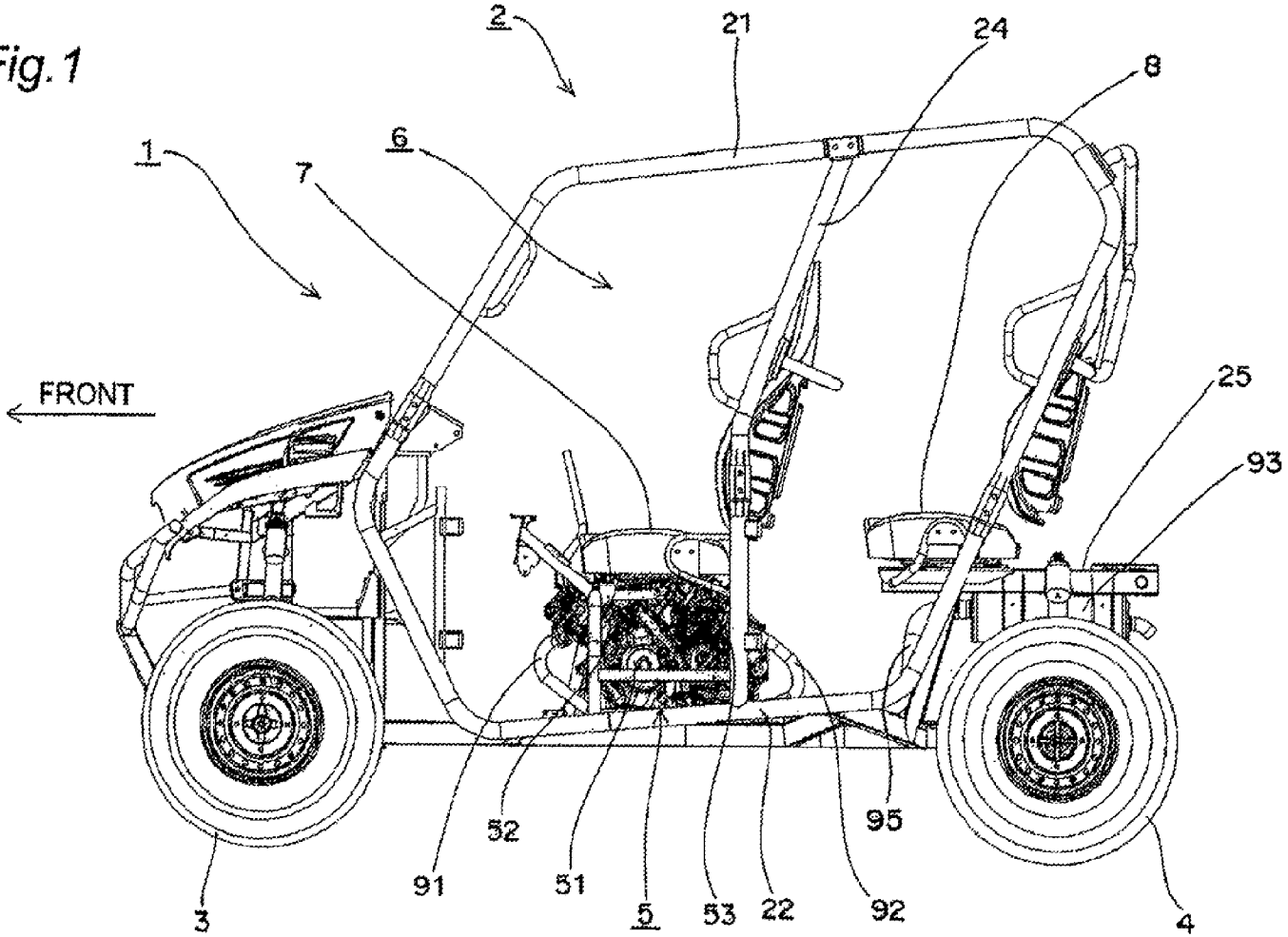
FIG. 1 is a left side view of a utility vehicle according to an embodiment of the present invention.
Figure 2:
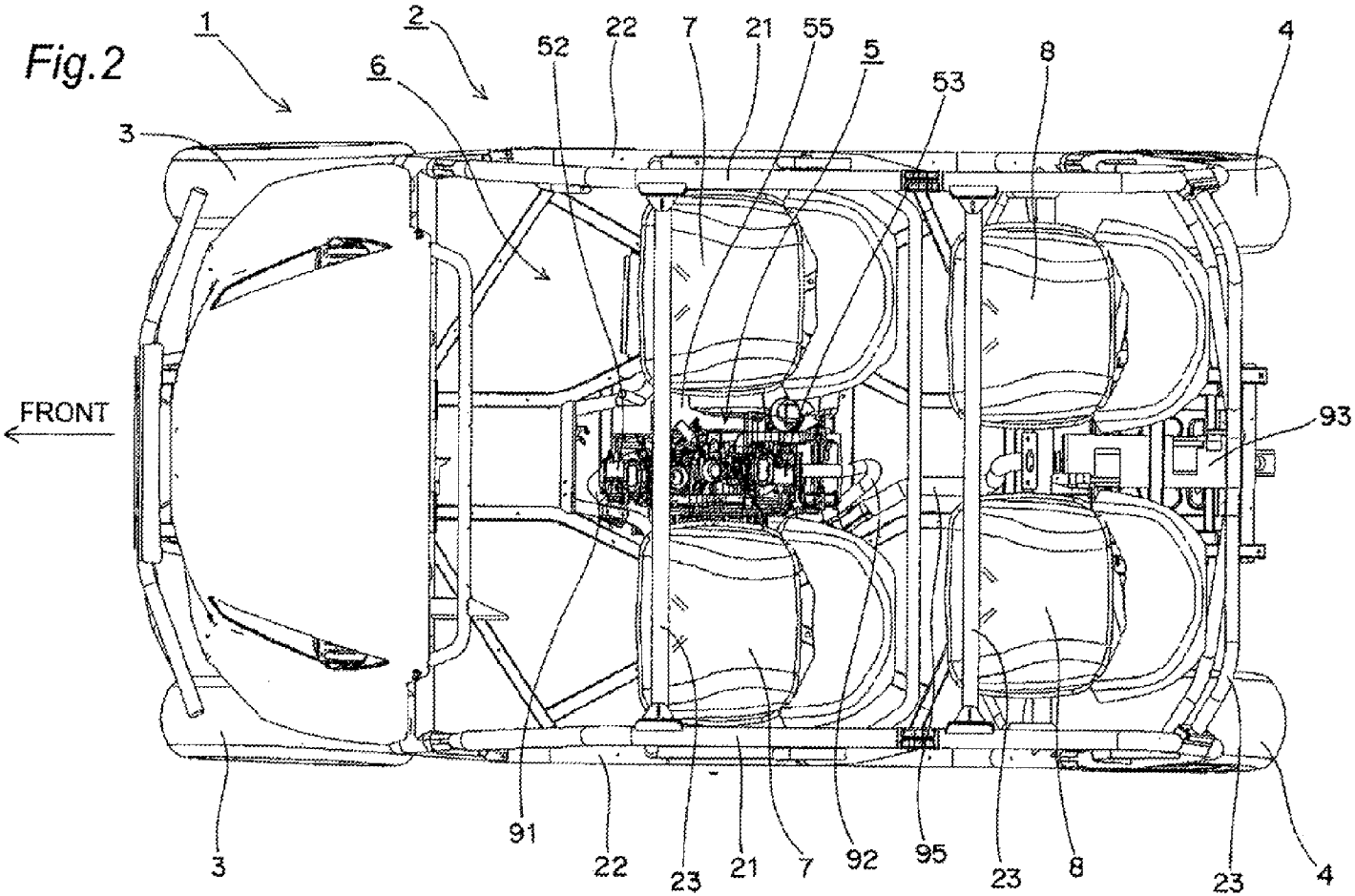
FIG. 2 is a top view of the utility vehicle of FIG. 1.

FIG. 1 is a left side view of the utility vehicle according to the embodiment of the present invention, and FIG. 2 is a top view of the utility vehicle of FIG. 1. A utility vehicle 1 is provided with a pair of left and right front wheels 3 and a pair of left and right rear wheels 4 respectively in a front part and a rear part of a vehicle body frame 2, and a V-twin engine 5 is mounted between the front and rear wheels 3, 4.

The vehicle body frame 2 has a pair of left and right cabin frames (BOPS) 21 formed by metal pipes into a reversed U shape, main frames 22 formed by metal pipes into a U shape, the main frames being coupled to the cabin frames (ROPS) 21 from the lower side, a plurality of cross members 23 formed by metal pipes, the cross members coupling the pair of left and right cabin frames (ROPS) 21, and upper pillar pipes 24 coupling intermediate parts in the front and rear direction of the cabin frames (BOPS) 21 and intermediate parts in the front and rear direction of the main frames 22. The cabin frames 21 are generally called as ROPS which is an abbreviation of rollover protective structure.

A front seat 7 having a box shape driver seat and a box shape passenger seat is installed in a front half part of the cabin 6 formed by the vehicle body frame 2, and a rear seat 8 having two box shape fellow passenger seats is installed in a rear half part of the cabin 6.

The engine 5 is provided with a front cylinder 52 with a forward tilting posture and a rear cylinder 53 with a rearward tilting posture on the upper side of a crankcase 51. An exhaust port (not shown) is formed in a front wall of the front cylinder 52, and a front cylinder exhaust pipe 91 is connected to the exhaust port. An exhaust port (not shown) is formed in a rear wall of the rear cylinder 53, and a rear cylinder exhaust pipe 92 is connected to the exhaust port. A single muffler 93 shared by the front and rear cylinders is arranged in the vicinity of the lower side of a loading platform 25 in a rear part of the rear seat 8 and in a substantially center part in the lateral direction.

Figure 3:
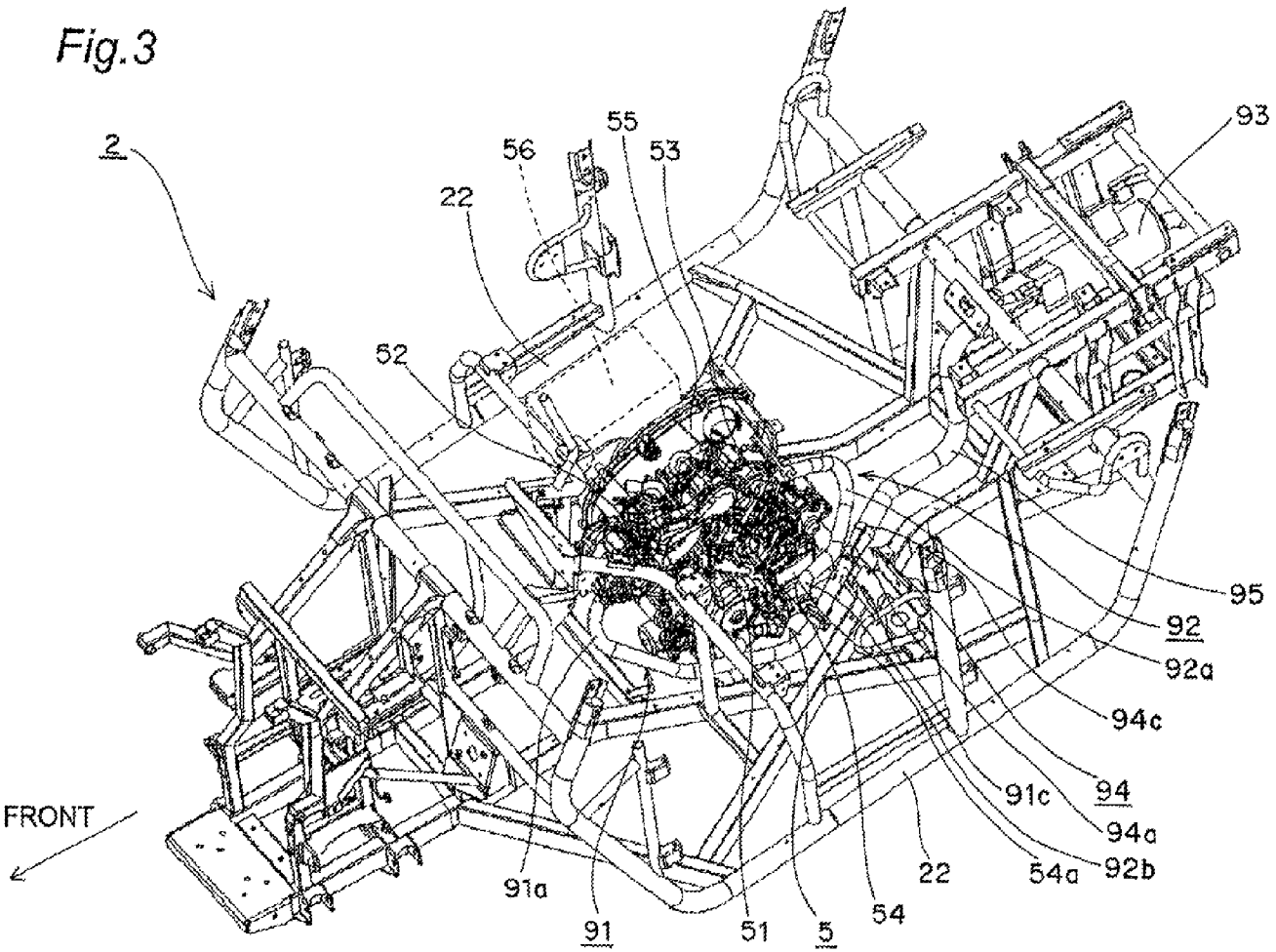
FIG. 3 is a perspective view showing a part of a vehicle body frame, an engine, and an exhaust device of FIGS. 1 and 2.

FIG. 3 is a perspective view showing a part of the vehicle body frame 2, the engine 5, and an exhaust device of FIGS. 1 and 2. The exhaust device has the front cylinder exhaust pipe 91, the rear cylinder exhaust pipe 92, the muffler 93, a collecting pipe 94 collecting the front cylinder exhaust pipe 91 and the rear cylinder exhaust pipe 92, and a downstream exhaust pipe 95 reaching from the collecting pipe 94 to the muffler 93.

Figure 4:
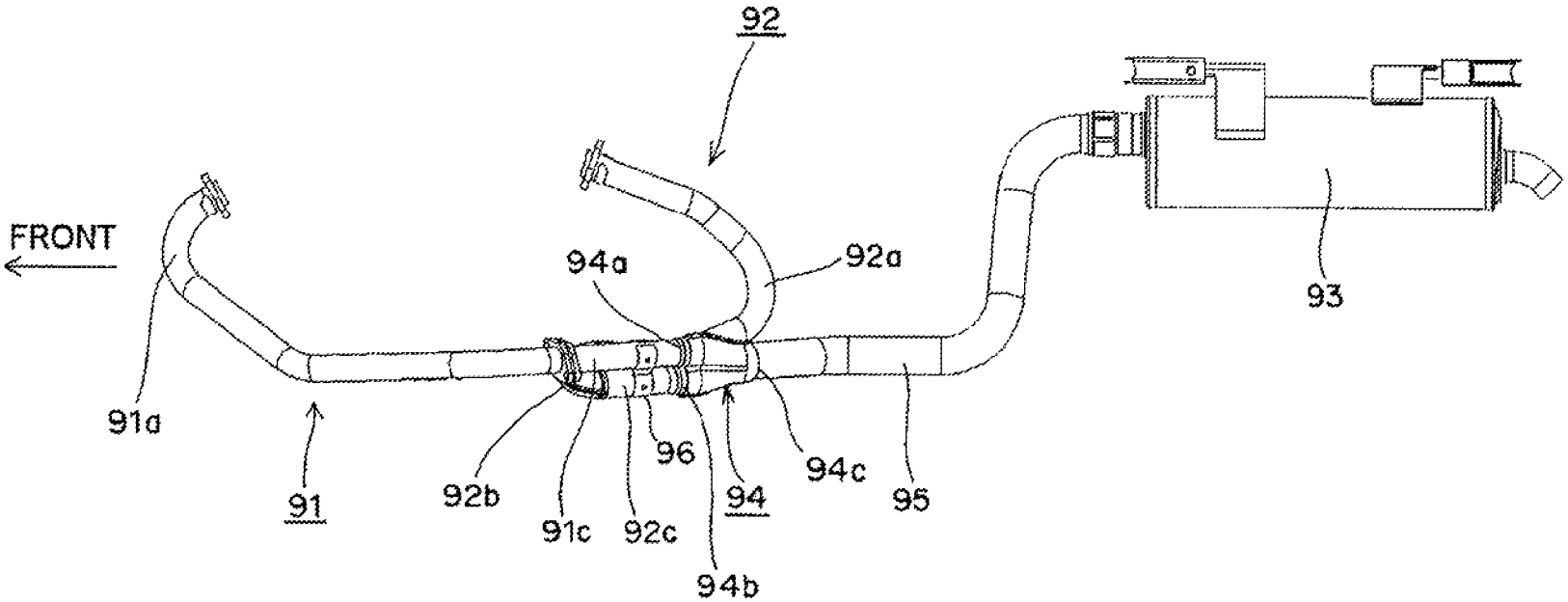
FIG. 4 is a side view showing the exhaust device.
Figure 5:
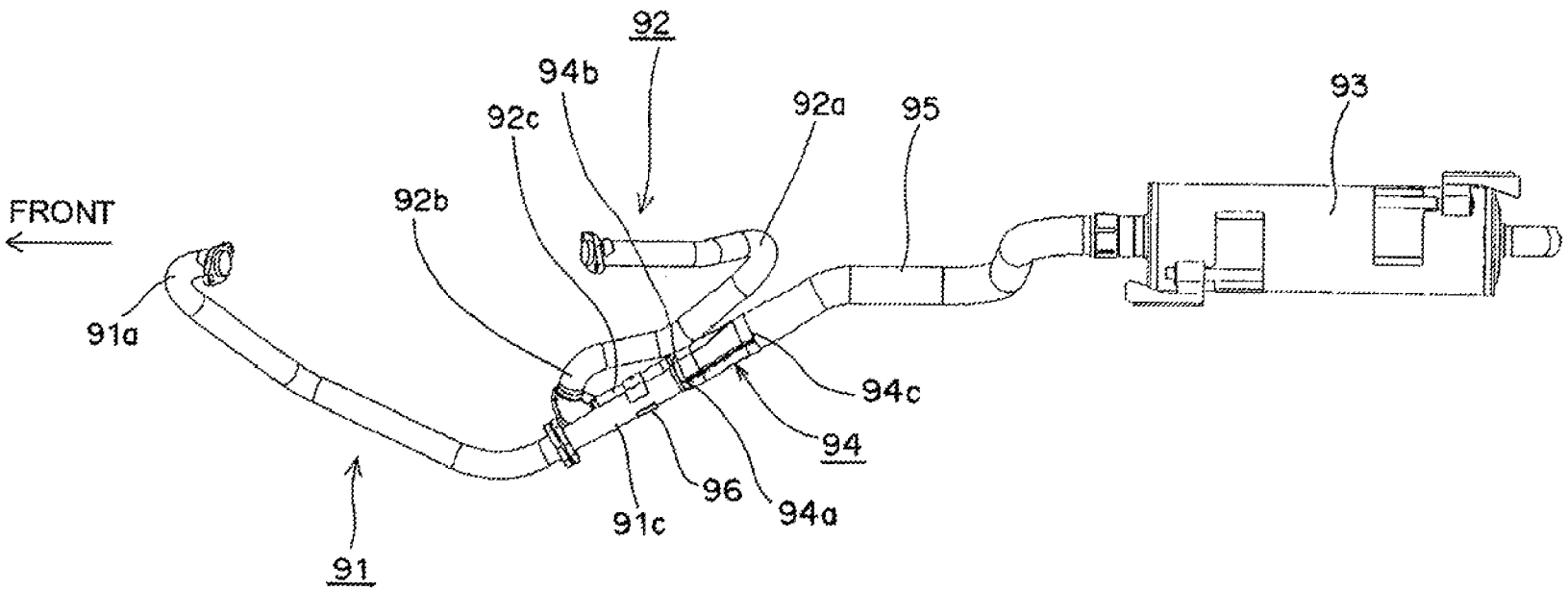
FIG. 5 is a perspective view of FIG. 4.

FIG. 4 is a side view showing the exhaust device, and FIG. 5 is a perspective view of FIG. 4. As shown in FIGS. 3 to 5, the front cylinder exhaust pipe 91 extends forward from the front cylinder 52 of the engine 5 and changes the direction from forward to rearward in a front exhaust pipe curved portion 91*a*. The front exhaust pipe curved portion 91*a* is positioned in the vicinity of the front side of the engine 5. The front cylinder exhaust pipe 91 extends rearward from the front exhaust pipe curved portion 91*a* to the left lower side, passes through the side in the lateral direction of a lower part of the engine 5, and reaches to a front exhaust pipe straight portion 91*c* formed into a substantially straight line. A rear end of the front exhaust pipe straight portion 91*c* is connected to the collecting pipe 94.

Figure 6:
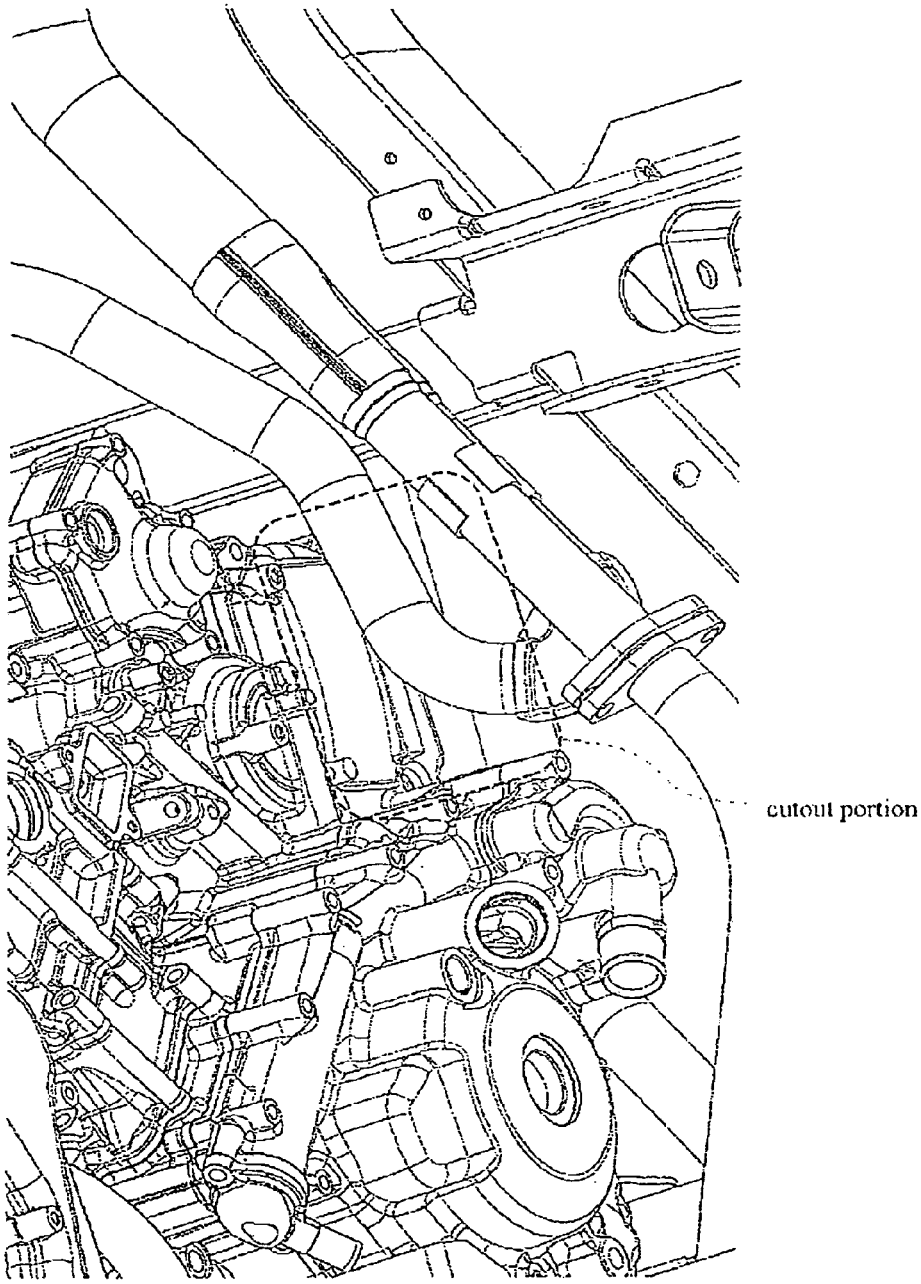
FIG. 6 is an enlarged view of the vehicle body frame, engine, and exhaust device of FIG. 3 showing a cutout portion of an oil pan.

The rear cylinder exhaust pipe 92 extends rearward from the rear cylinder 53 of the engine 5, and changes the direction from rearward to forward in a first rear exhaust pipe curved portion 92*a*. The first rear exhaust pipe curved portion 92*a* is positioned in the vicinity of the rear side of the engine 5. The rear cylinder exhaust pipe 92 extends forward from the first rear exhaust pipe curved portion 92*a* to the left lower side, passes through the side in the lateral direction of the lower part of the engine 5, and changes direction from forward to rearward in a second rear exhaust pipe curved portion 92*b*. The second rear exhaust pipe curved portion 92*b* is positioned on the side of the engine 5 in the lateral direction of a rear lower part of the engine 5. As shown in dashed lines in FIG. 6, a cutout portion 54*a* is formed in a left side part, in the lateral direction, of an oil pan 54 positioned in the lower part of the engine 5, and a part of the second rear exhaust pipe curved portion 92*b* is positioned in the vicinity of the cutout portion 54*a*. The rear cylinder exhaust pipe 92 extends rearward from the second rear exhaust pipe curved portion 92*b*, passes through the side in the lateral direction of a lower rear part of the engine 5, and reaches to a rear exhaust pipe straight portion 92*c* formed into a substantially straight line. A rear end of the rear exhaust pipe straight portion 92*c* is connected to the collecting pipe 94.

The rear cylinder exhaust pipe 92 has the first rear exhaust pipe curved portion 92*a* and the second rear exhaust pipe curved portion 92*b*, so that total length thereof is extended. As a result, total length of the front cylinder exhaust pipe 91 and the total length of the rear cylinder exhaust pipe 92 are substantially the same. For example, a ratio between the total length of the front cylinder exhaust pipe 91 and the total length of the rear cylinder exhaust pipe 92 is within a range from 3:2 to 2:3. The front exhaust pipe straight portion 91*c* and the rear exhaust pipe straight portion 92*c* respectively have length of at least 100 mm, and are integrally supported by one support member 96.

The collecting pipe 94 has two inlets 94*a*, 94*b* in a front end thereof, and one outlet 94*c* in a rear end. The inlets 94*a*, 94*b* are respectively connected to the front exhaust pipe straight portion 91*c* and the rear exhaust pipe straight portion 92*c*, and the outlet 94*c* is connected to a front end of the downstream exhaust pipe 95. As a result, an exhaust gas passing through the front cylinder exhaust pipe 91 and an exhaust gas passing through the rear cylinder exhaust pipe 92 are collected in the collecting pipe 94 and fed to the downstream exhaust pipe 95.

As shown in FIG. 3, a V-belt continuously variable transmission 55 for transmitting rotation force of a main shaft of the engine 5 to the rear wheels 4 by a V-belt is provided in a right part of the engine 5, and a fuel tank 56 storing fuel to be supplied to the engine 5, the fuel tank shown by a broken line is arranged on the right side in the lateral direction of the continuously variable transmission 55. The collecting pipe 94 collecting the front cylinder exhaust pipe 91 and the rear cylinder exhaust pipe 92 is arranged on the opposite side in the lateral direction (on the left side in the lateral direction) of the continuously variable transmission 55 and the fuel tank 56 relative to the engine 5.

As shown in FIGS. 1 to 3, the downstream exhaust pipe 95 extends rearward from a connection part with the collecting pipe 94, passes through the lower side of the substantially center part in the lateral direction of the rear seat 8, goes to the upper side, and is connected to a front end of the muffler 93 attached to a lower surface of the loading platform 25 in the substantially center part in the lateral direction. A front part of the loading platform 25 supports a seating portion of the rear seat 8.

An attaching order of the exhaust device is as follows. Firstly, the collecting pipe 94 is connected to the front end of the downstream exhaust pipe 95. Next, an exhaust upstream end of the front cylinder exhaust pipe 91 is connected to the exhaust port of the front cylinder 52, and an exhaust downstream end of the front cylinder exhaust pipe 91 is connected to the collecting pipe 94. Accordingly, an exhaust upstream end of the rear cylinder exhaust pipe 92 is connected to the exhaust port of the rear cylinder 53, and an exhaust downstream end of the rear cylinder exhaust pipe 92 is connected to the collecting pipe 94. The front exhaust pipe straight portion 91*c* of the front cylinder exhaust pipe 91 and the rear exhaust pipe straight portion 92*c* of the rear cylinder exhaust pipe 92 are supported by the support member 96. Then, the muffler 93 is connected to a rear end of the downstream exhaust pipe 95 from the rear side, and attached to the lower surface of the loading platform 25.

As described above, the front cylinder exhaust pipe 91, the rear cylinder exhaust pipe 92, the collecting pipe 94, and the downstream exhaust pipe 95 are supported not by the vehicle body frame 2 or the like but by the front cylinder 52, the rear cylinder 53, the support member 96, and the muffler 93.

According to the above embodiment, the following effects can be obtained.

(1) The total length of the front cylinder exhaust pipe 91 and the total length of the rear cylinder exhaust pipe 92 are substantially the same. Thus, exhaust interference generated between the front cylinder exhaust pipe 91 and the rear cylinder exhaust pipe 92 can be suppressed, and further an exhaust performance of the front and rear cylinders 52, 53 can be substantially equalized. As a result, an output of the engine 5 can be improved.

(2) Since the front cylinder exhaust pipe 91 is provided with the front exhaust pipe curved portion 91*a*, and the rear cylinder exhaust pipe 92 is provided with the first rear exhaust pipe curved portion 92*a* and the second rear exhaust pipe curved portion 92*b*, the total length of the front cylinder exhaust pipe 91 and the total length of the rear cylinder exhaust pipe 92 can be easily made substantially the same. The front exhaust pipe curved portion 91*a* is positioned in the vicinity of the front side of the engine 5, the first rear exhaust pipe curved portion 92*a* is positioned in the vicinity of the rear side of the engine 5, and the second rear exhaust pipe curved portion 92*b* is positioned in the vicinity of the side in the lateral direction of a rear part of the engine 5. Thus, the front cylinder exhaust pipe 91 and the rear cylinder exhaust pipe 92 can be arranged around the engine 5. As a result, a thermal influence from the front cylinder exhaust pipe 91 and the rear cylinder exhaust pipe 92 to the outer side in the lateral direction can be reduced.

(3) The collecting pipe 94 is arranged on the opposite side in the lateral direction of the continuously variable transmission 55 and the fuel tank 56 relative to the engine 5. Thus, the front cylinder exhaust pipe 91, the rear cylinder exhaust pipe 92, and the collecting pipe 94 having a relatively high temperature among the exhaust pipes are spaced from the continuously variable transmission 55 and the fuel tank 56 by a fixed distance via the engine 5. Therefore, the thermal influence on the continuously variable transmission 55 and the fuel tank 56 by the front cylinder exhaust pipe 91, the rear cylinder exhaust pipe 92, and the collecting pipe 94 can be reduced.

(4) The front cylinder exhaust pipe 91 and the rear cylinder exhaust pipe 92 respectively have the front exhaust pipe straight portion 91*c* formed into a straight line and the rear exhaust pipe straight portion 92*c* formed into a straight line in the connection parts to the collecting pipe 94. Thus, movement of exhaust from the front cylinder exhaust pipe 91 to the collecting pipe 94, and movement of exhaust from the rear cylinder exhaust pipe 92 to the collecting pipe 94 can be smoothly performed.

(5) The front exhaust pipe straight portion 91*c* and the rear exhaust pipe straight portion 92*c* are integrally supported by the shared support member 96. Thus, the support member 96 can be simplified, so that the front exhaust pipe straight portion 91*c* and the rear exhaust pipe straight portion 92*c* can be supported in a rational manner. The front exhaust pipe straight portion 91*c* and the rear exhaust pipe straight portion 92*c* having fixed length in a straight line are supported by the support member 96. Thus, integrity of the front cylinder exhaust pipe 91 and the rear cylinder exhaust pipe 92 can be improved. As a result, vibration generated between the front cylinder exhaust pipe 91 and the rear cylinder exhaust pipe 92 can be eased.

(6) A part of the second rear exhaust pipe curved portion 92*b* is positioned in the vicinity of the cutout portion 54*a* of the oil pan 54. Thus, the rear cylinder exhaust pipe 92 can be brought close to the left side in the lateral direction of the engine 5, so that the thermal influence from the rear cylinder exhaust pipe 92 to the outer side in the lateral direction can be reduced.

(7) The engine 5 and the muffler 93 are arranged in the substantially center part in the lateral direction, and the downstream exhaust pipe 95 passes through the lower side of the substantially center part in the lateral direction of the rear seat 8. Thus, total length of the downstream exhaust pipe 95 can be shortened. As a result, weight of the downstream exhaust pipe 95 can be reduced, and the output of the engine at the time of high speed can be improved. Since the downstream exhaust pipe 95 is arranged in the substantially center part in the lateral direction, the thermal influence from the downstream exhaust pipe 95 to the outer side in the lateral direction can be reduced.

(8) The front cylinder exhaust pipe 91, the rear cylinder exhaust pipe 92, the collecting pipe 94, and the downstream exhaust pipe 95 are supported by the front cylinder 52, the rear cylinder 53, the support member 96, and the muffler 93. Thus, there is no need for separately providing a support member for the above members in the vehicle body frame 2 or the like, so that a support structure can be simplified. By simplifying the support structure, an extra arrangement space can be obtained around the front cylinder exhaust pipe 91, the rear cylinder exhaust pipe 92, the collecting pipe 94, and the downstream exhaust pipe 95.

In the present embodiment, the downstream exhaust pipe 95 passes through the lower side of the substantially center part in the lateral direction of the rear seat 8. However, in a case where the front cylinder exhaust pipe 91 and the rear cylinder exhaust pipe 92 are not collected by the collecting pipe 94, the exhaust pipes are preferably connected to the muffler 93 through the lower side of the substantially center part in the lateral direction of the rear seat 8 so that the total length of the exhaust pipes is shortened.

In the present embodiment, the front cylinder exhaust pipe 91 has the front exhaust pipe curved portion 91*a*. However, the number of a curved portion to be provided is not limited to one as in the front exhaust pipe curved portion 91*a* but other curved portions may be provided. The rear cylinder exhaust pipe 92 has the first rear exhaust pipe curved portion 92*a* and the second rear exhaust pipe curved portion 92*b*. However, the number of a curved portion to be provided is not limited to two as in the first rear exhaust pipe curved portion 92*a* and the second rear exhaust pipe curved portion 92*b* but other curved portions may be provided. That is, in the front cylinder exhaust pipe 91 and the rear cylinder exhaust pipe 92, a proper number of curved portions are preferably formed so that the total length of the front cylinder exhaust pipe 91 and the total length of the rear cylinder exhaust pipe 92 are made substantially the same and the front cylinder exhaust pipe 91 and the rear cylinder exhaust pipe 92 are arranged in the vicinity of the engine 5.

OTHER EMBODIMENTS OF THE INVENTION (1) The present invention is applicable to a twin engine other than the V-twin engine.

(2) The present invention is applicable to a vehicle for irregular terrain other than the vehicle in the above embodiment.

The present invention can provide the exhaust device capable of suppressing the exhaust interference generated between the front cylinder exhaust pipe and the rear cylinder exhaust pipe, and further substantially equalizing the exhaust performance of the front and rear cylinders. Thus, the present invention has a great applicability in industry.

The invention claimed is:

1. An exhaust device of a vehicle provided with a V-engine having a front cylinder and a rear cylinder, comprising:

a muffler arranged in a rear part of the vehicle;

a front cylinder exhaust pipe connected to a front surface of the front cylinder;

a rear cylinder exhaust pipe connected to a rear surface of the rear cylinder;

a collecting pipe collecting the front cylinder exhaust pipe and the rear cylinder exhaust pipe; and a downstream exhaust pipe reaching from the collecting pipe to the muffler, wherein:

a total length of the front cylinder exhaust pipe and a total length of the rear cylinder exhaust pipe are substantially the same;

the collecting pipe is arranged on a side of a rear part of the engine in the lateral direction of the vehicle;

the front cylinder exhaust pipe has a front exhaust pipe curved portion changing direction from forward to rearward;

the front exhaust pipe curved portion is positioned in a vicinity of a front side of the engine;

the rear cylinder exhaust pipe has, in order from an exhaust upstream side, a first rear exhaust pipe curved portion changing direction from rearward to forward, and a second rear exhaust pipe curved portion changing direction from forward to rearward;

the first rear exhaust pipe curved portion is positioned in a vicinity of a rear side of the engine, and the second rear exhaust pipe curved portion is positioned at the side of the rear part of the crankcase of the engine, the front cylinder exhaust pipe has a front exhaust pipe straight portion that is formed in a straight line and is connected to the collecting pipe, the rear cylinder exhaust pipe has a rear exhaust pipe straight portion that is formed in a straight line and is connected to the collecting pipe, and the front exhaust pipe straight portion and the rear exhaust pipe straight portion respectively have a length of at least 100 mm.

2. The exhaust device according to claim 1, wherein the collecting pipe is arranged on an opposite side of the vehicle in a lateral direction relative to a fuel tank or a transmission of the vehicle.

3. The exhaust device according to claim 2, wherein the front exhaust pipe straight portion and the rear exhaust pipe straight portion are integrally supported by a shared support member.

4. The exhaust device according to claim 1, wherein:

a cutout portion of an oil pan is formed in a side part of the oil pan in the lateral direction of the engine, and a part of the second rear exhaust pipe curved portion is positioned in a vicinity of the cutout portion.

5. The exhaust device according to claim 1, wherein:

the vehicle has a front seat and a rear seat in order from a front side of the vehicle;

the engine is arranged at a lower side of the front seat and below a substantially center part of the front seat in the lateral direction of the front seat;

the muffler is arranged in a vicinity of a lower side of a loading platform positioned in a rear part of the rear seat and in a substantially center part of the loading platform in the lateral direction of the rear seat; and the downstream exhaust pipe extends to the muffler at a lower side of the rear seat and in substantially a center part of the rear seat in the lateral direction of the rear seat.

6. A utility vehicle provided with the exhaust device according to claim 1.

7. An exhaust device of a vehicle provided with a V-engine having a front cylinder and a rear cylinder, the exhaust device comprising:

a muffler arranged in a rear part of the vehicle;

a front cylinder exhaust pipe connected to a front surface of the front cylinder;

a rear cylinder exhaust pipe connected to a rear surface of the rear cylinder;

a collecting pipe collecting the front cylinder exhaust pipe and the rear cylinder exhaust pipe; and a downstream exhaust pipe reaching from the collecting pipe to the muffler, wherein:

a total length of the front cylinder exhaust pipe and a total length of the rear cylinder exhaust pipe are substantially the same;

the collecting pipe is arranged on a side of a rear part of the engine in the lateral direction of the vehicle;

the front cylinder exhaust pipe has a front exhaust pipe curved portion changing direction from forward to rearward;

the front exhaust pipe curved portion is positioned in a vicinity of a front side of the engine;

the rear cylinder exhaust pipe has, in order from an exhaust upstream side, a first rear exhaust pipe curved portion changing direction from rearward to forward, and a second rear exhaust pipe curved portion changing direction from forward to rearward at a rear portion of the crankcase;

the first rear exhaust pipe curved portion is positioned on a rear side of the engine, and the second rear exhaust pipe curved portion is positioned so as to oppose the side of the rear part of the engine in the lateral direction of the vehicle such that the second rear exhaust pipe curved portion is positioned closer to a rear part of the crankcase than a front part of the crankcase, the front cylinder exhaust pipe has a front exhaust pipe straight portion that is formed in a straight line and is connected to the collecting pipe, the rear cylinder exhaust pipe has a rear exhaust pipe straight portion that is formed in a straight line and is connected to the collecting pipe, and the front exhaust pipe straight portion and the rear exhaust pipe straight portion respectively have a length of at least 100 mm.

8. The exhaust device according to claim 7, wherein the second rear exhaust pipe curved portion is positioned close to the side of the rear part of the engine adjacent the rear part of the crankcase of the engine.

9. The exhaust device according to claim 7, wherein the collecting pipe is arranged on an opposite side of the vehicle in a lateral direction relative to a fuel tank or a transmission of the vehicle.

10. The exhaust device according to claim 7, wherein the front exhaust pipe straight portion and the rear exhaust pipe straight portion are integrally supported by a shared support member.

11. The exhaust device according to claim 7, wherein:

a cutout portion of an oil pan is formed in a side part of the oil pan in the lateral direction of the engine, and a part of the second rear exhaust pipe curved portion is positioned in the cutout portion.

12. The exhaust device according to claim 7, wherein:

the vehicle has a front seat and a rear seat in order from a front side of the vehicle;

the engine is arranged at a lower side of the front seat and below a substantially center part of the front seat in the lateral direction of the front seat;

the muffler is arranged in a vicinity of a lower side of a loading platform positioned in a rear part of the rear seat and in a substantially center part of the loading platform in the lateral direction of the rear seat; and the downstream exhaust pipe extends to the muffler at a lower side of the rear seat and in substantially a center part of the rear seat in the lateral direction of the rear seat.

13. A utility vehicle provided with the exhaust device according to claim 7.

* * * * *